US009567171B2

(12) United States Patent
Iwama

(10) Patent No.: US 9,567,171 B2
(45) Date of Patent: Feb. 14, 2017

(54) SHEET STACKABLE DEVICE AND IMAGE FORMING APPARATUS

(71) Applicant: BROTHER KOGYO KABUSHIKI KAISHA, Nagoya-shi, Aichi-ken (JP)

(72) Inventor: Noritaka Iwama, Aichi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/837,608

(22) Filed: Aug. 27, 2015

(65) Prior Publication Data

US 2016/0062295 A1 Mar. 3, 2016

(30) Foreign Application Priority Data

Aug. 29, 2014 (JP) ..... 2014-175025

(51) Int. Cl.
*B65H 1/04* (2006.01)
*G03G 15/00* (2006.01)

(52) U.S. Cl.
CPC ..... *B65H 1/04* (2013.01); *G03G 15/6502* (2013.01); *B65H 2405/1142* (2013.01); *B65H 2511/12* (2013.01)

(58) Field of Classification Search
CPC ..... B65H 2511/12; B65H 2405/1142; B65H 2405/11425; B65H 2405/1144
USPC ..... 271/171
See application file for complete search history.

(56) References Cited

U.S. PATENT DOCUMENTS 7,464,927 B2 * 12/2008 Ito ..... B65H 1/266 271/145
8,052,141 B2 * 11/2011 Yamagishi ..... B65H 1/266 271/171
8,267,397 B2 * 9/2012 Shimazu ..... B41J 13/103 271/145
8,882,377 B2 * 11/2014 Kim ..... B65H 1/266 271/171
9,008,565 B2 * 4/2015 Taniguchi ..... G03G 15/6505 271/145
9,027,920 B2 * 5/2015 Sato ..... B65H 1/04 271/171
9,162,833 B2 * 10/2015 Udagawa ..... B65H 1/266 271/171
2003/0193130 A1 10/2003 Park
(Continued)

FOREIGN PATENT DOCUMENTS

JP 2002-19973 A 1/2002
JP 2002-128284 A 5/2002
(Continued)

*Primary Examiner* — Jeremy R Severson
(74) *Attorney, Agent, or Firm* — Merchant & Gould P.C.

(57) ABSTRACT

A sheet stackable device including a sheet stackable bin and a first edge guide is provided. The first edge guide is slidable in a first direction. The sheet stackable bin includes a first rail to guide the first edge guide, a second rails to guide the first edge guide, and teeth arranged along the first direction. The first edge guide includes a first protrusion configured to contact the first rail along a second direction orthogonal to the first direction, a second protrusion configured to contact the second rail, a locking part engageable with the teeth, and a handle to disengage the locking part from the teeth. The handle is arranged in a position between the first rail and the second rail with regard to the second direction.

11 Claims, 9 Drawing Sheets

(56) References Cited

U.S. PATENT DOCUMENTS

| | | | | |
|---|---|---|---|---|
| 2006/0113723 | A1 | 6/2006 | Ito et al. | |
| 2006/0222434 | A1* | 10/2006 | Kitamura | B65H 1/04 400/624 |
| 2009/0295072 | A1* | 12/2009 | Blair | B65H 1/00 271/171 |
| 2009/0295073 | A1* | 12/2009 | Furusawa | B65H 1/266 271/171 |
| 2013/0001867 | A1* | 1/2013 | Akatsuka | B65H 1/266 271/171 |
| 2015/0102552 | A1* | 4/2015 | Doshida | B65H 1/04 271/171 |

FOREIGN PATENT DOCUMENTS

| | | | |
|---|---|---|---|
| JP | 2002-274662 | A | 9/2002 |
| JP | 2003-300631 | A | 10/2003 |
| JP | 2006-151656 | A | 6/2006 |
| JP | 2010-173800 | A | 8/2010 |

* cited by examiner

SHEET STACKABLE DEVICE AND IMAGE FORMING APPARATUS

CROSS REFERENCE TO RELATED APPLICATION

This application claims priority from Japanese Patent Application No. 2014-175025, filed on Aug. 29, 2014, the entire subject matter of which is incorporated herein by reference.

BACKGROUND

Technical Field

The present invention relates to a sheet stackable device and an image forming apparatus.

Related Art

A sheet stackable device, such as a sheet feeder cassette, having a sheet tray, on which sheets may be stacked, and an edge guide, which may be movable with respect to the sheet tray, is known. In this sheet stackable device, the edge guide may have an upright part to restrict a position of the sheets stacked on the sheet tray. The sheet tray may have a guide rail that guides the edge guide to move along a bottom of the sheet tray. The edge guide may have a handle, which may be pressed toward the upright part by a user. When the handle is pressed toward the upright part, the handle may rotate about a shaft extending vertically, and the edge guide may be unlocked from the guide rail.

When the handle is pressed to move the restrictive part along the bottom of the sheet tray, a rotation moment produced in the edge guide may affect the edge guide to incline with respect to the guide rail, and movability or operability of the restrictive part may be lowered.

SUMMARY

The present disclosure is advantageous in that a sheet stackable device with an edge guide, of which operability may be improved, is provided. Further, an image forming apparatus having the sheet stackable device may be provided.

According to an aspect of the present disclosure, a sheet stackable device, including a sheet stackable bin; and a first edge guide slidably mounted on the sheet stackable bin to be slidable in a first direction and configured to contact an edge of a sheet when the sheet is stacked on the sheet stackable bin, is provided. The sheet stackable bin includes a first rail extending in the first direction and configured to guide the first edge guide; a second rail extending in the first direction and configured to guide the first edge guide, the second rail being arranged in a position spaced apart from the first rail with regard to a second direction being orthogonal to the first direction; and a plurality of teeth arranged in a position between the first rail and the second rail, the plurality of teeth being arranged along the first direction. The first edge guide includes a first protrusion protruding toward the first rail in the second direction and configured to contact the first rail; a second protrusion protruding toward the second rail in the second direction and configured to contact the second rail; a locking part configured to engage with one of the plurality of teeth to restrict the first edge guide from moving in the first direction when the locking part engages with the one of the plurality of teeth; and a handle configured to disengage the locking part toward a direction to be farther from the one of the plurality of teeth. The handle is arranged in a position between the first rail and the second rail with regard to the second direction.

According to another aspect of the present disclosure, an image forming apparatus, including a sheet stackable device with a sheet stackable bin and a first edge guide; and an image forming unit configured to form an image on the sheet; is provided. The first edge guide is slidably mounted on the sheet stackable bin to be slidable in a first direction and configured to contact an edge of a sheet when the sheet is stacked on the sheet stackable bin. The sheet stackable bin includes a first rail extending in the first direction and configured to guide the first edge guide; a second rail extending in the first direction and configured to guide the first edge guide, the second rail being arranged in a position spaced apart from the first rail with regard to a second direction being orthogonal to the first direction; and a plurality of teeth arranged in a position between the first rail and the second rail, the plurality of teeth being arranged along the first direction. The first edge guide includes a first protrusion protruding toward the first rail in the second direction and configured to contact the first rail; a second protrusion protruding toward the second rail in the second direction and configured to contact the second rail; a locking part configured to engage with one of the plurality of teeth to restrict the first edge guide from moving in the first direction when the locking part engages with the one of the plurality of teeth; and a handle configured to disengage the locking part toward a direction to be farther from the one of the plurality of teeth. The handle is arranged in a position between the first rail and the second rail with regard to the second direction.

BRIEF DESCRIPTION OF THE ACCOMPANYING DRAWINGS

DETAILED DESCRIPTION

Figure 1:
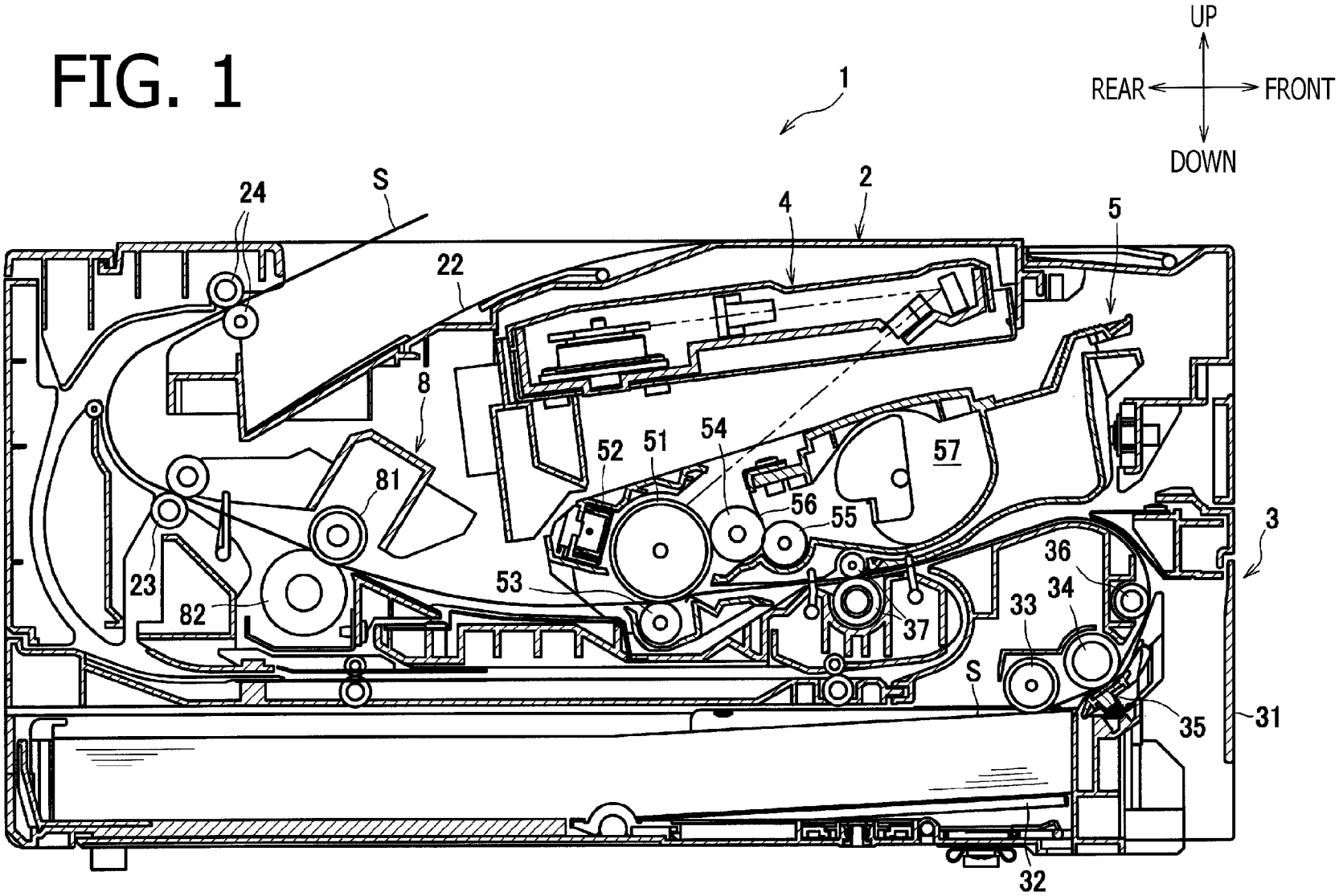
FIG. 1 is a cross-sectional side view of a laser printer according to an embodiment of the present disclosure.

Hereinafter, an embodiment of the present invention will be described with reference to the accompanying drawings. First, an overall configuration of a laser printer 1 according to the embodiment will be described, and later, a feeder tray 31 in the laser printer 1 will be described in detail. In the following description, directions concerning the laser printer 1 and parts and components in the laser printer 1 will be referred to based on a user's position to ordinarily use the laser printer 1 and in accordance with orientation indicated by arrows in each drawings. That is, for example, a viewer's right-hand side appearing in FIG. 1 is referred to as a front side of the laser printer 1. A left-hand side in FIG. 1 opposite from the front is referred to as a rear side. A side, which corresponds to the viewer's nearer side is referred to as a left-hand side, and an opposite side from the left, which corresponds to the viewer's farther side, is referred to as a right-hand side. A right-to-left or left-to-right direction of the laser printer 1 may also be referred to as a widthwise direction. A front-to-rear or rear-to-front direction may also be referred to as a front-rear direction. An up-to-down or down-to-up direction in FIG. 1 corresponds to a vertical direction of the laser printer 1. The widthwise direction, the front-rear direction, and the vertical direction are orthogonal to one another.

As shown in FIG. 1, the laser printer 1 includes a body 2, a feeder unit 3, an exposure unit 4, a processing cartridge 5, and a fixing unit 8, which are accommodated in the body 2.

The feeder unit 3 is disposed in a lower position in the body 2 and includes a feeder tray 31, a lifting board 32, a feeder roller 33, a separator roller 34, a separator pad 35, a conveyer roller 36, and registration rollers 37. The feeder unit 3 conveys sheets S to the processing cartridge 5. More specifically, the sheets S stored in the feeder tray 31 are lifted upward by the lifting board 32 to be urged against the feeder roller 33. The sheets S are forwarded by the feeder roller 33 and separated from one another by the separator roller 34 and the separator pad 35 to be conveyed one-by-one by the conveyer roller 36 and the registration rollers 37 to the processing cartridge 5.

The exposure unit 4 is disposed in an upper position in the body 2 and includes a laser emitter (not shown), a polygon mirror, lenses, and reflective mirrors, which are shown but unsigned. A laser berm, which is indicated by a double-dotted line in FIG. 1, may be emitted from a laser source toward a photosensitive drum 51 to scan a circumferential surface of the photosensitive drum 51 so that the circumferential surface of the photosensitive drum 51 is selectively exposed to the laser beam.

The processing cartridge 5 is removably installed in the body 2 through an opening (unsigned), which is formed on a front face of the body 2 and exposed when a front cover (unsigned) is opened. The processing cartridge 5 includes the photosensitive drum 51, a charger 52, a transfer roller 53, a developer roller 54, a supplier roller 55, a toner-flattening blade 56, and a toner container 57 to contain toner.

In the processing cartridge 5, the circumferential surface of the photosensitive drum 51 is evenly charged electrically by the charger 52 and exposed selectively to the laser beam emitted from the exposure unit 4 as the photosensitive drum 51 rotates. Accordingly, electric potential in an area selectively exposed to the laser beam is lowered, and a latent image is formed in the lower potential area. Toner contained in the toner container 57 is supplied to the developer roller 54 through the supplier roller 55 and is flattened evenly by the toner-flattening blade 56 to form a predetermined thickness of a toner layer on the developer roller 54. The toner on the developer roller 54 is supplied to the latent image formed on the circumferential surface of the photosensitive drum 51 to be developed so that a toner image is formed on the circumferential surface of the photosensitive drum 51. Thereafter, the toner image on the circumferential surface of the photosensitive drum 51 is transferred by the developer roller 53 onto the sheet S, which is fed to the processing cartridge 5 by the feeder unit 3.

The fixing unit 8 is disposed in a rearward position with respect to the processing cartridge 5 and includes a heat roller 81 and a pressure roller 82. The pressure roller 82 is disposed to oppose the heat roller 81 and is arranged to press the heat roller 81. When the sheet S with the transferred toner image passes by an intermediate position between the heat roller 81 and the pressure roller 82, the toner transferred onto the surface of the sheet S is thermally fixed thereon. The sheet S with the thermally fixed image is carried by conveyer rollers 23, 24 and is released in a sheet outlet tray 22.

Figure 2:
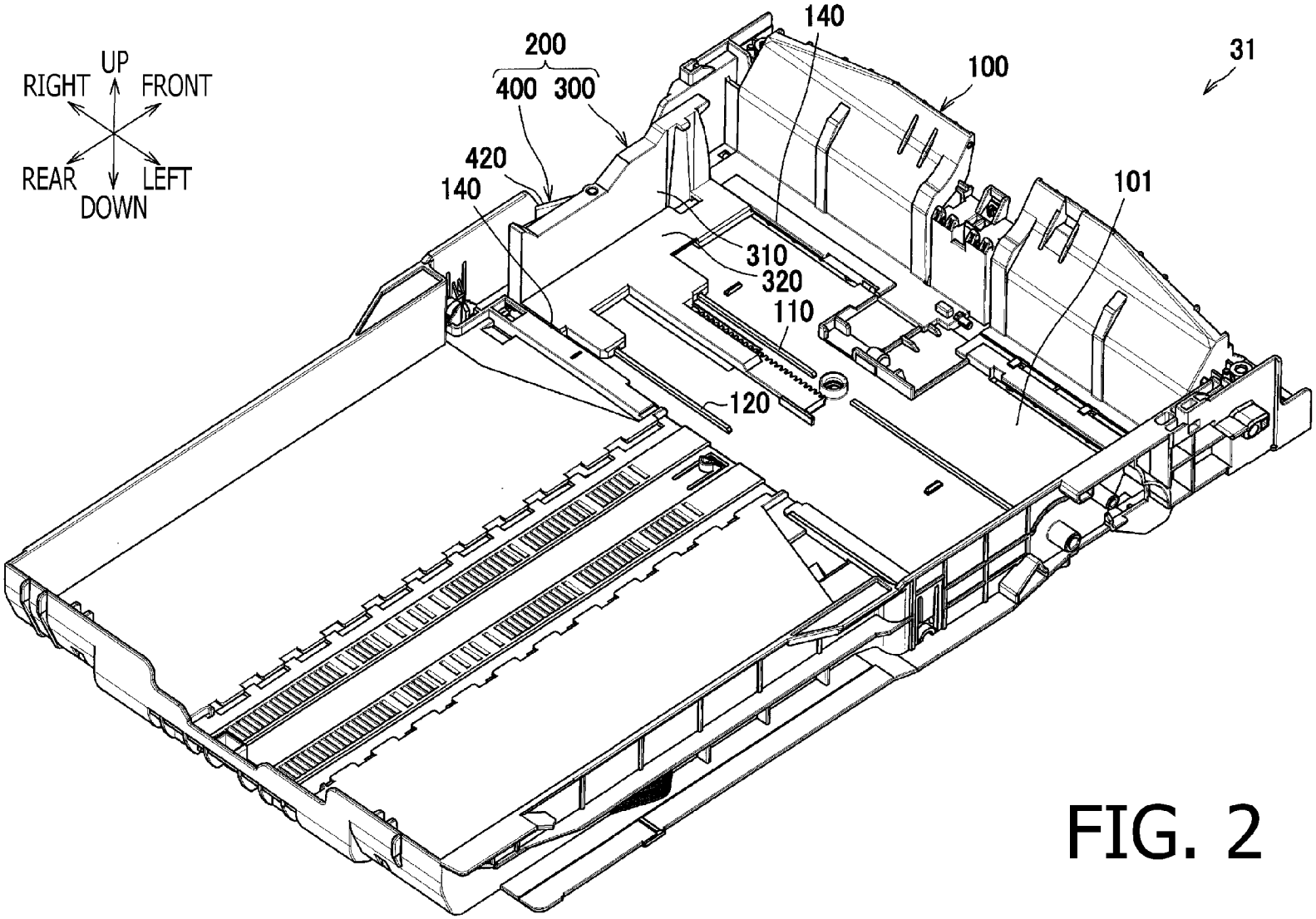
FIG. 2 is a perspective view of a feeder tray according to the embodiment of the present disclosure.
Figure 3:
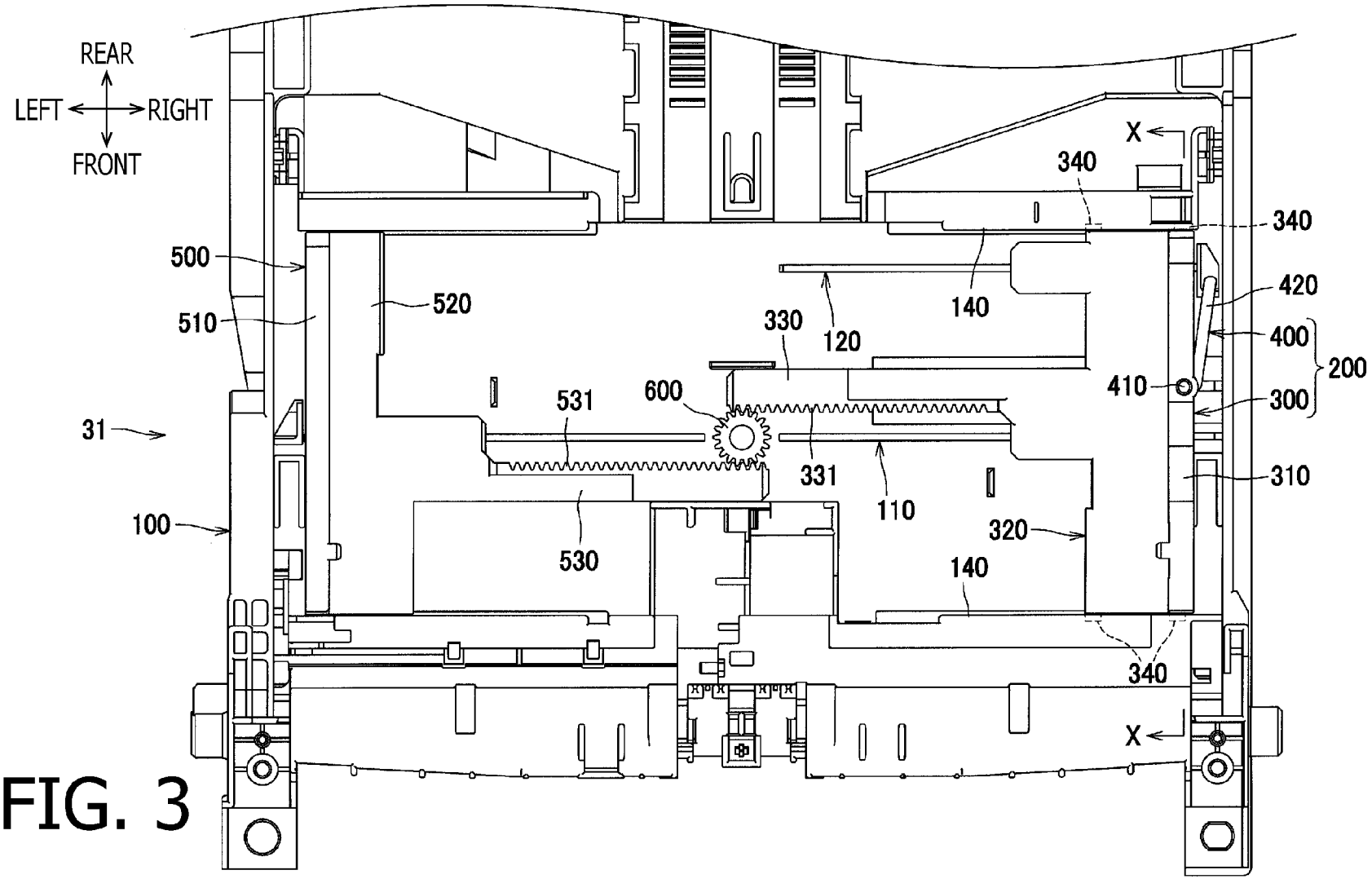
FIG. 3 is a plan view of a front part of the feeder tray according to the embodiment of the present disclosure.

As shown in FIGS. 2 and 3, the feeder tray 31 is detachably attached to a lower part of the body 2. The feeder tray 31 includes a stackable bin 100, an edge guide 200 including a right-side guide 300 and a manipulation member 400, a left-side guide 500, and a pinion gear 600. The edge guide 200 is movable along the widthwise direction in the feeder tray 31.

Figure 4:
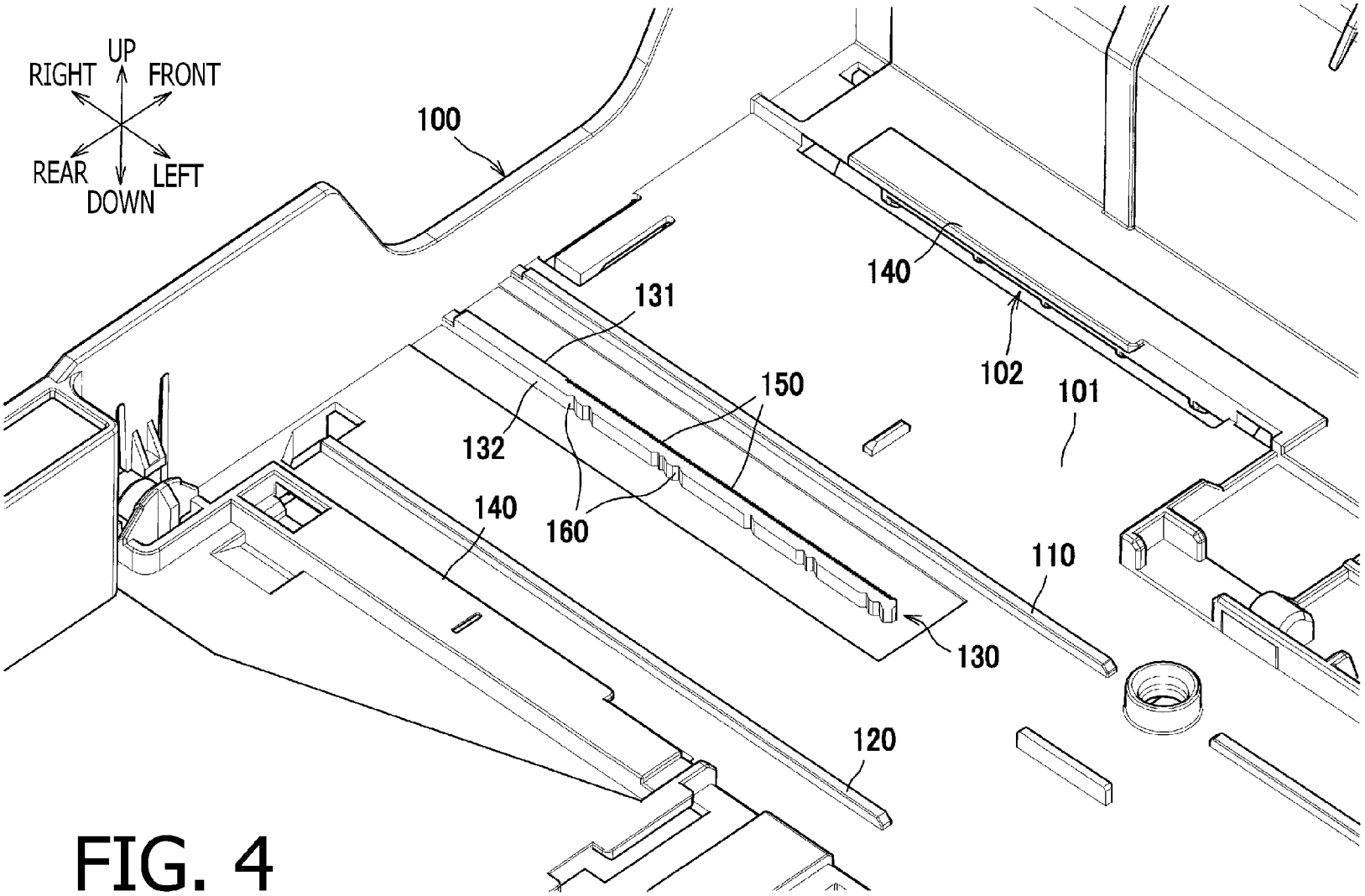
FIG. 4 is a perspective view of a stackable bin for the feeder tray according to the embodiment of the present disclosure.

The stackable bin 100 has a form of a top-open box, in which the sheet(s) S may be stacked (see also FIG. 1). As shown in FIG. 4, the stackable bin 100 includes a first rail 110, a second rail 120, a basal bar 130, and a stopper-engageable part 140.

The first rail 110 and the second rail 120 are provided to guide the edge guide 200 to move there-along. The first rail 110 and the second rail 120 are each formed to protrude upward from a bottom 101 of the stackable bin 100 in a shape of a rail extending longitudinally along the widthwise direction. The first rail 110 and the second rail 120 are formed to be spaced apart from each other in the front-rear direction and extend longitudinally along the widthwise direction in parallel with each other. The first rail 110 may be formed in a frontward position, and a second rail 120 may be formed in a rearward position.

The basal bar 130 is formed to protrude upward from the bottom 101 of the stackable bin 110 to extend longitudinally along the widthwise direction in a position between the first rail 110 and the second rail 120 with regard to the front-rear direction. The basal bar 130 has a frontward face 131 and a rearward face 132. The basal bar 130 is formed to have a plurality of teeth 150, which are oriented frontward, along the front-rear direction, on the frontward face 131; and a plurality of position-indicative notches 160, which are oriented rearward, along the front-rear direction, on the rearward face 132.

Each position-indicative notch 160 is formed to dent in a shape of a V, which is narrowed to point frontward, in a plan view. The position-indicative notches 160 are formed in positions corresponding to commonly available regular sizes of the sheets S, which may be placed on the stackable bin 110. The regular sizes of the sheets S may include, for example, a legal size, A4 size, a letter size, and B5 size. Each tooth 150 is formed to dent in a shape of a V, which is narrowed to point rearward, in a plan view. The teeth 150 are formed in a serrate shape aligning along the widthwise direction at a smaller interval than an interval between adjoining position-indicative notches 160.

The stopper-engageable part 140 includes a pair of plates, which are arranged in outer sides of the first rail 110 and the second rail 120 to extend inward with regard to the front-rear direction. The stopper-engageable part 140 is arranged in an upward spaced-apart position with respect to an upper surface of the bottom 101 of the stackable bin 100 to extend longitudinally along the widthwise direction. Between the stopper-engageable part 140 and the bottom 101 of the stackable bin 100, formed is a clearance 102, in which stopper claws 340 (see FIG. 5) of the right-side guide 300 may be inserted.

Figure 5:
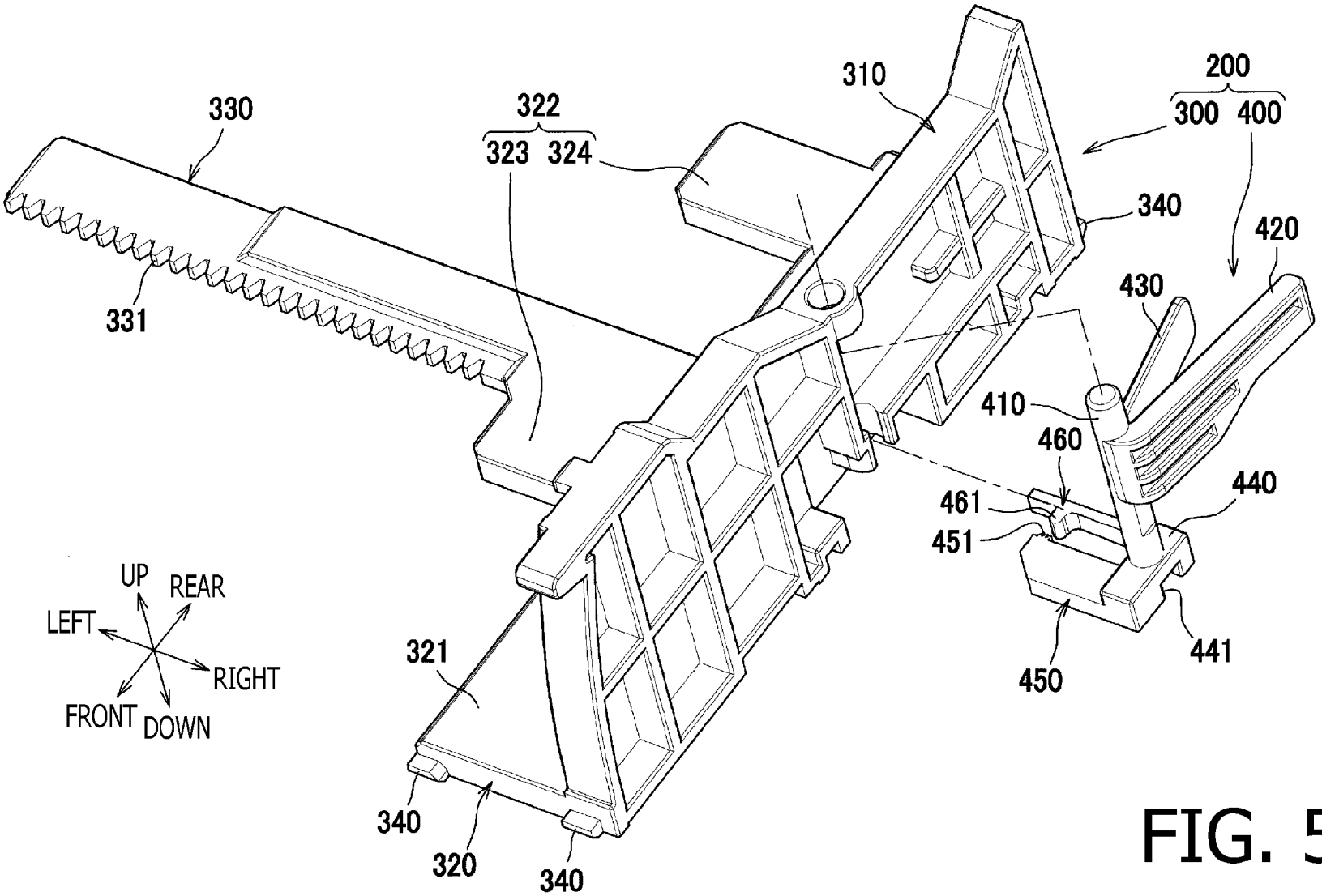
FIG. 5 is an exploded view of an edge guide for the feeder tray according to the embodiment of the present disclosure.

As shown in FIG. 5, the edge guide 200 includes the right-side guide 300 and the manipulation member 400. The right-side guide 300 is provided to restrict a widthwise position of the sheets S stacked on the stackable bin 100. The right-side guide 300 has an approximate shape of an L in a front view and is slidably movable with respect to the stackable bin 100 along the widthwise direction. The right-side guide 300 is integrally formed to have a restrictive plate 310, an base plate 320, a gear part 330, the stopper claws 340, a first protrusion 350 (see FIG. 6), and a second protrusion 360 (see FIG. 6).

The restrictive plate 310 has an approximate shape of a plate and is arranged to contact rightward edges of the sheets S stacked on the stackable bin 100 to restrict the widthwise position of the sheets S.

The base plate 320 is formed to extend from a lower end of the restrictive plate 310 in a movable direction of the right-side guide 300, e.g., leftward. The base plate 320 includes a basal part 321, which is connected to the lower end of the restrictive plate 310 and has an approximate rectangular shape in a plan view, and an extending part 322, which protrudes in the moving direction, e.g., leftward, from a leftward end of the basal part 321. The extending part 322 includes a first extending part 323 and a second extending part 324. The first extending part 323 protrudes leftward from a central area, with regard to the front-rear direction, of the leftward end of the basal part 321. The second extending part 324 protrudes leftward from a rearward area of the leftward end of the basal part 321.

Figure 6:
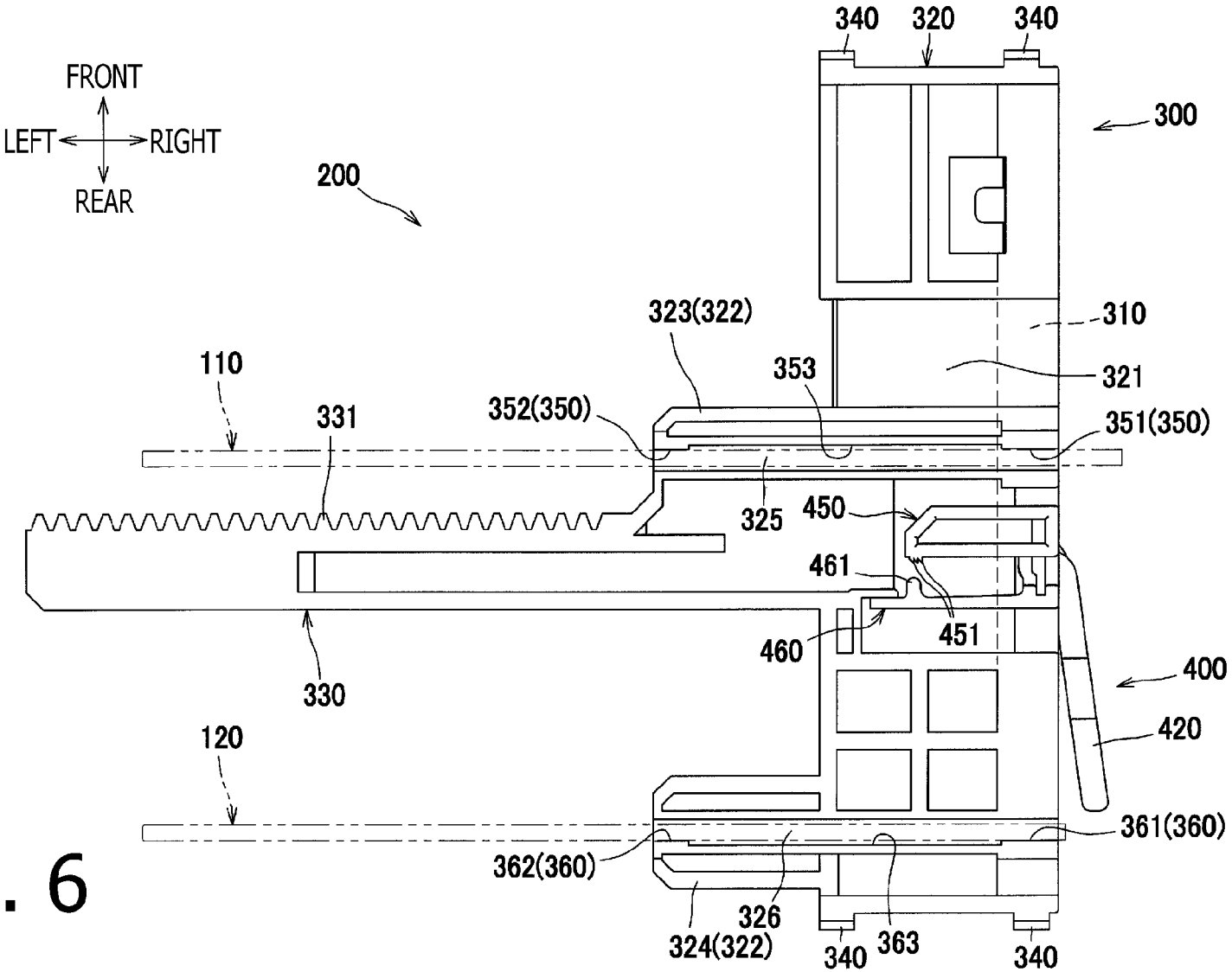
FIG. 6 is a plan view of the edge guide, viewed from a bottom, for the feeder tray according to the embodiment of the present disclosure.

The base plate 302, of which plan view from a bottom is shown in FIG. 6, includes a first groove 325 and a second groove 326 on a bottom thereof. The first groove 325 is formed to encase the first rail 110 therein, and the second groove 326 is formed to encase the second rail 120 therein. The first groove 325 and the second groove 326 each is a dent, which is formed to be open downward and extending along the widthwise direction. The first groove 325 is formed at a central position, with regard to the front-rear direction, in the base plate 320 to extend through a bottom of the basal part 321 and a bottom of the first extending part 323. The second groove 326 is formed at a rearward position in the base plate 320 to extend through the bottom of the basal part 321 and a bottom of the second extending part 324.

The gear part 330 extends leftward from the base plate 320 and is formed to have a first rack gear 331 on a frontward face thereof. The gear part 330 is formed to extend leftward from the first extending part 323 of the base plate 320. In this regard, a dimension in the front-rear direction (depth) of the first extending part 323 is greater than a dimension (depth) of the gear part 330 in the front-rear direction. In other words, the first extending part 323 and the gear part 330 form an elongated part, which extends leftward originating from the same central area, with regard to the front-rear direction, of the leftward end of the basal part 321; and a dimension in the front-rear direction of an area closer to the origin, i.e., the first extending part 323, of the elongated part is greater than a dimension in the front-rear direction of an end area, i.e., the gear part 330, of the elongated part.

Figure 7:
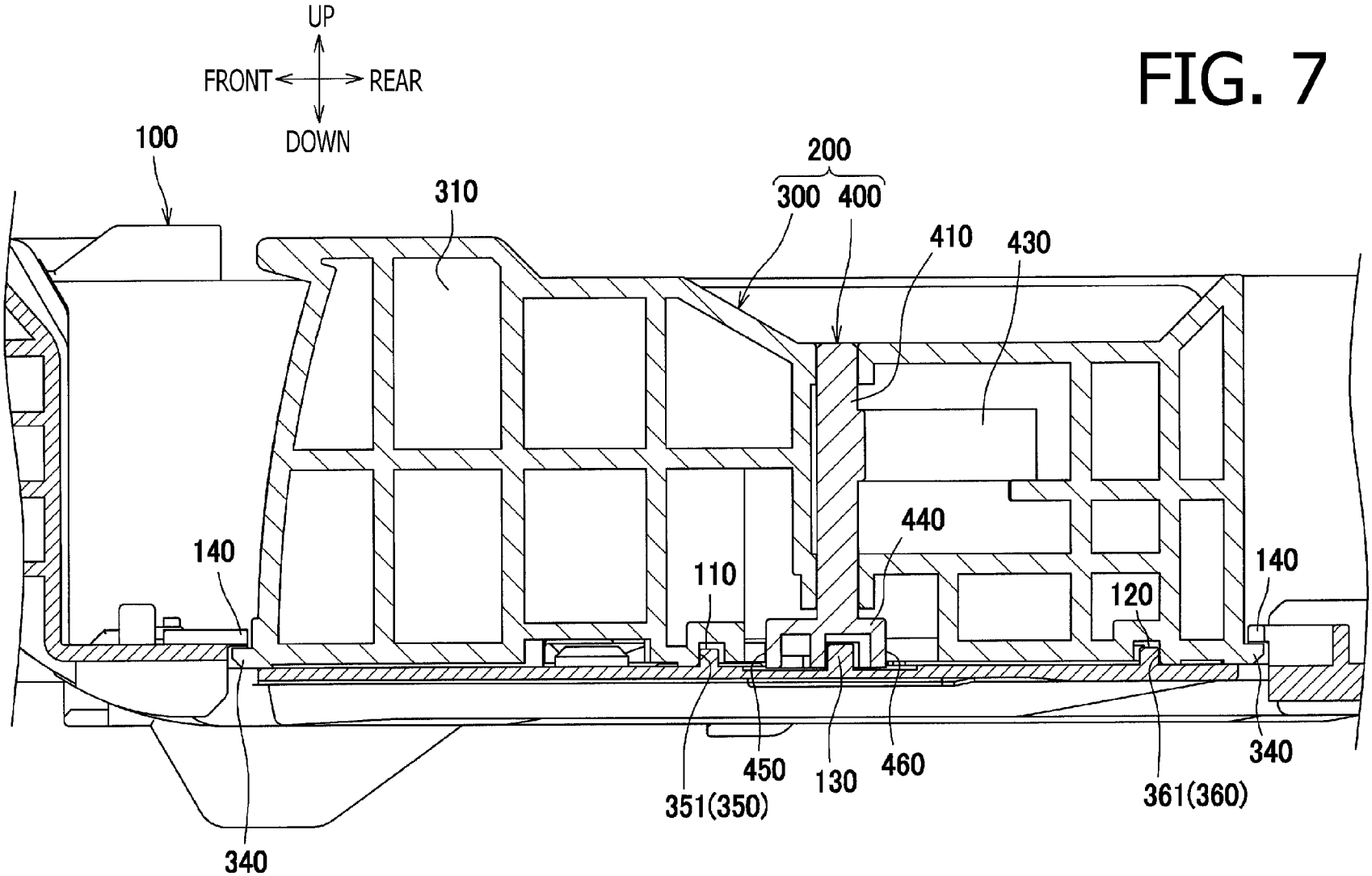
FIG. 7 is a cross-sectional view of the feeder tray according to the embodiment of the present disclosure taken at a line X-X shown in FIG. 3.

The stopper claws 340 are formed to protrude outward from widthwise ends on a front end and a rear end of the basal part 321 respectively along the front-rear direction; therefore, there are four (4) stopper claws 340, each on a corner of the basal part 321 in the right-side guide 300. As shown in FIG. 7, the stopper claws 340 are each arranged to contact a lower face of the stopper-engageable part 140 at an upper face thereof to be engaged with the stopper-engageable part 140. In other words, the stopper-engageable part 140 is in contact with the upper surfaces of the stopper claws 340 to be engageable with the stopper claws 340.

While the edge guide 200 is installed in the stackable bin 100, gaps are formed between a frontward end of the right-side guide 300 and a frontward one of the stopper-engageable parts 140, and between a rearward end of the right-side guide and a rearward one of the stopper-engageable parts 140, respectively. Further, gaps are formed between frontward ends of the stopper claws 340 on the front and the stackable bin 100, and between rearward ends of the stopper claws 340 on the rear and the stackable bin 100, respectively. Each amount of these gaps is greater than an amount of a gap formed between the first protrusion 350 and the first rail 110, and than an amount of a gap formed between the second protrusion 360 and the second rail 120. Therefore, when the edge guide 200 moves frontward or rearward, the first and second protrusions 350, 360 contact or conflict with the first and second rails 110, 120 respectively before the frontward or rearward end of the right-side guide 300 should contact the stopper engageable part 140. In other words, the frontward and rearward ends of the right-side guide 300 are prevented from contacting the stopper-engageable parts 140; and the frontward and rearward ends of the stopper claws 340 are prevented from contacting the stackable bin 100.

Referring back to FIG. 6, the first protrusion 350 may contact the first rail 110 to be engageable with the first rail 110 in the front-rear direction. The first protrusion 350 includes a rightward first protrusion 351 and a leftward first protrusion 352. The rightward first protrusion 351 is formed to protrude rearward from one of widthwise ends of the edge guide 200, e.g., a rightward end, of a frontward face of the first groove 325. The leftward first protrusion 352 is formed to protrude rearward from the other one of the widthwise ends of the edge guide 200, e.g., a leftward end, of the frontward face of the first groove 325. In particular, the rightward first protrusion 351 is formed on the rightward end of the basal part 321, and the leftward first protrusion 352 is formed on the leftward end of the first extending part 323. An intermediate part between the rightward first protrusion 351 and the leftward first protrusion 352 with regard to the widthwise direction forms a dent 353, which is recessed frontward with respect to the rightward first protrusion 351 and the leftward first protrusion 352 so that the dent 353 should not contact the first rail 110.

The second protrusion 360 may contact the second rail 120 to be engageable with the second rail 120 in the front-rear direction. The second protrusion 360 includes a rightward second protrusion 361 and a leftward second protrusion 362. The rightward second protrusion 361 is formed to protrude frontward from one of widthwise ends of the edge guide 200, e.g., a rightward end, of a rearward face of the second groove 326. The leftward second protrusion 362 is formed to protrude frontward from the other one of the widthwise ends of the edge guide 200, e.g., a leftward end, of the rearward face of the second groove 326. In particular, the rightward second protrusion 361 is formed on the rightward end of the basal part 321, and the leftward second protrusion 362 is formed on the leftward end of the second extending part 324. An intermediate part between the rightward second protrusion 361 and the leftward second protrusion 362 with regard to the widthwise direction forms a dent 363, which is recessed rearward with respect to the rightward second protrusion 361 and the leftward second protrusion 362 so that the dent 363 should not contact the second rail 120.

The rightward first protrusion 351 and the rightward second protrusion 361 align with each other along the front-rear direction, and the leftward first protrusion 352 and the leftward second protrusion 362 align with each other along the front-rear direction. Therefore, an area enclosed by the rightward first protrusion 351, the rightward second protrusion 361, the leftward first protrusion 352, and the leftward second protrusion 362 forms a rectangle.

An amount of a gap formed between the first protrusion 350 and the first rail 110 is smaller than an amount of a gap formed between the second rail 120 and a frontward face of the second groove 326. Therefore, when the edge guide 200 moves rearward, the first protrusion 350 may contact or conflict with the first rail 110, and thereby the edge guide 200 may be restricted from moving further rearward. Meanwhile, an amount of a gap formed between the second protrusion 360 and the second rail 120 is smaller than an amount of a gap formed between the first rail 110 and a rearward face of the first groove 325. Therefore, when the edge guide 200 moves frontward, the second protrusion 360 may contact or conflict with the second rail 120, and thereby the edge guide 200 may be restricted from moving further frontward.

As shown in FIG. 5, the manipulation member 400 is integrally formed to have a shaft 410, a handle 420, an urging part 430, a base part 440, a locking part 450, and a positioning part 460. The shaft 410 is formed to extend along the vertical direction and has a cylindrical form. While the shaft 410 is rotatably supported by the right-side guide 300, the manipulation member 400 including the handle 420, the locking part 450, and the positioning part 460 are integrally rotatable about the shaft 410.

Figure 8:
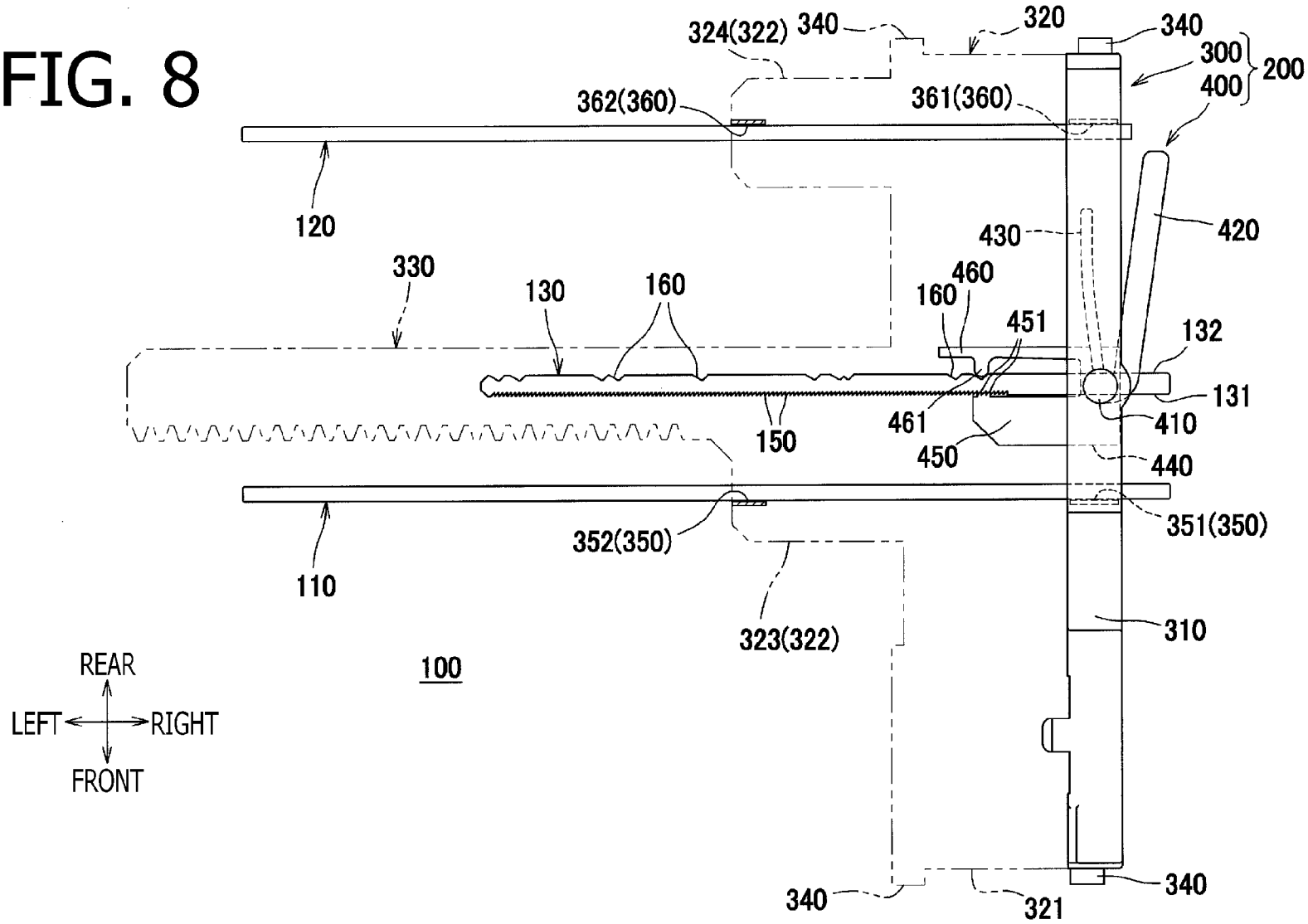
FIG. 8 is a plan view of the edge guide viewed from above when a handle is in a non-operative position in the feeder tray according to the embodiment of the present disclosure.

As shown in FIG. 8, the handle 420 is a piece of plate, which is arranged to extend rear-rightward from the shaft 410 in adjacent to the restrictive plate 310 on a widthwise outer side of the restrictive plate 310. The handle 420 is rotatable to move the locking part 450 by being pressed to be closer to the restrictive plate 310 so that the locking part 450 is disengaged from the teeth 150. Detailed behaviors of the handle 420 will be described later.

The urging part 430 is a piece of plate, which is arranged to extend rear-leftward from the shaft 410. After the urging member 430 being resiliently pressed against the restrictive plate 310, the handle 420 may be moved by a restoring force of the urging member 430 to be away from the restrictive plate 310.

The base part 440 is arranged at a lower end of the shaft 410 and connects the shaft 410 with the locking part 450 and the positioning part 460. At a bottom of the base part 440, formed is a dent 441 (see FIG. 5), in which the basal bar 130 may be inserted.

The locking part 450 is arranged to extend leftward from a frontward end of the base part 440 and has a plurality of locking projections 451, which protrude rearward to be engageable with a portion of the teeth 150. The locking part 450 may, when engaged with a portion of the teeth 150, restrict the edge guide 200 from moving in the widthwise direction.

The positioning part 460 is arranged to extend leftward from a rearward end of the base part 440 and has a positioning projection 461, which is engageable with one of the position-indicative notches 160. The positioning part 460 is resiliently deformable, in particular, in the front-rear direction, so that the positioning projection 461 may be engaged with and disengaged from the position-indicative notch 160.

The locking part 450 and the positioning part 460 are, while the edge guide 200 is installed in the stackable bin 100, arranged to clamp the basal bar 130 from the front and the rear. The locking part 450 and the positioning part 460 are placed to be, when the handle 420 is not operated, i.e., when the handle 420 is in a non-operational position (see FIG. 8), in a restrictive position, in which the locking projections 451 engage with a portion of the teeth 150, and the positioning projection 461 engages with one of the position-indicative notches 160. The positioning part 460 is arranged to have the positioning projection 461 to engage with one of the position-indicative notches 160 when the restrictive plate 310 is in one of the positions corresponding to the regular sizes of the sheets S, such as the legal size, A4 size, etc., but not to engage with any of the position-indicative notches 160 when the restrictive plate 310 is not in any of the positions corresponding to the regular sizes of the sheets S. When the restrictive plate 310 is not in any of the positions corresponding to the regular sizes of the sheets S, the positioning projection 461 contacts a part of the rearward face 132, in which no position-indicative notch 160 is formed, and the positioning part 460 is resiliently bent rearward.

While the edge guide 200 is installed in the stackable bin 100, the handle 420, the locking projections 451 in the locking part 450, and the positioning projection 461 in the positioning part 460 are arranged in an intermediate position between the first rail 110 and the second rail 120 with regard to the front-rear direction. Further, the locking projections 451 in the locking part 450 and the positioning projection 461 in the positioning part 460 are in the rectangular area enclosed by the rightward first protrusion 351, the rightward second protrusion 361, the leftward first protrusion 352, and the leftward second protrusion 362.

The left-side guide 500 is provided to restrict, in conjunction with the right-side guide 300, the widthwise position of the sheets S stacked on the stackable bin 100. As shown in FIG. 3, the left-side guide 500 has an approximate shape of an L in a front view and is slidably movable with respect to the stackable bin 100 along the widthwise direction. The left-side guide 500 is in a substantially same configuration as the right-side guide 300. In particular, the left-side guide 500 is integrally formed to have a restrictive plate 510, an base plate 520, and a gear part 530.

The restrictive plate 510 has an approximate shape of a plate and is arranged to contact leftward edges of the sheets S, which are sandwiched by the left-side guide 500 and the right-side guide 300, to restrict the widthwise position of the sheets S. The base plate 520 is formed to extend from a lower end of the restrictive plate 510 leftward. The gear part 530 extends rightward from the base plate 520 and is formed to have a second rack gear 531, which is arranged at least partly to face with the first rack gear 331 in the gear part 330 of the right-side guide 300, on a rearward face thereof.

The pinion gear 600 is arranged to be rotatable with respect to the stackable bin 100 in a position between the first rack gear 331 and the second rack gear 531, and is engaged with the first rack gear 331 and the second rack gear 531. Thereby, when the right-side guide 300 is moved inward (e.g., leftward) along the widthwise direction, the left-side guide 500 may be moved in conjunction with the right-side guide 300 inward (e.g., rightward) along the widthwise direction so that the restrictive plates 310, 510 are moved to be closer to each other. When the right-side guide 300 is moved outward (e.g., rightward) along the widthwise direction, the left-side guide 500 may be moved in conjunction with the right-side guide 300 outward (e.g., leftward) along the widthwise direction so that the restrictive plates 310, 510 are moved to be farther from each other.

According to the feeder tray 31 described above, when the edge guide 200 is to be moved, the restrictive plate 310 and the handle 420 are nipped so that the handle 420 is urged toward the restrictive plate 310. Thereby, the handle 420 rotates about the shaft 410 counterclockwise to be shifted in an operative position (see FIG. 9). When the handle 420 is not nipped or operated by a user, the handle 420 is in a non-operative position (see FIG. 8).

The locking part 450 and the positioning part 460 are, when the handle 420 is in the operative position, the locking part 450 and the positioning part 460 are placed in a released position, in which the locking part 450 is disengaged from the teeth 150, and the positioning part 460 is resiliently deformed and urged against the rearward face 132 of the basal bar 130. More specifically, as the handle 420 is moved from the non-operative position to the operative position, the locking part 450 is manipulated to rotate counterclockwise about the shaft 410, and the locking projection 451 is disengaged from the teeth 150. Thereby, the edge guide 200 is released to be movable. Meanwhile, the positioning part 460 is moved clockwise about the shaft 410 to resiliently deform so that the positioning projection 461 is urged against the rearward face 132 of the basal bar 130.

Next, while the restrictive plate 310 and the handle 420 is nipped, i.e., while the handle 420 is maintained in the operative position, and when a force in the widthwise direction is applied to the edge guide 200, the edge guide 200 may be slidably moved in the widthwise direction along the first and second rails 110, 120. While the edge guide 200 is being moved in the widthwise direction, the positioning projection 460 in the positioning part 460 may fit in and exit the position-indicative notches 160 sequentially to be engaged with and disengaged therefrom. In this regard, the user may sense clicking reactions of the positioning projection 460 through the edge guide 200 and may be enabled to recognize a position to release the restrictive plate 310 and the handle 420 at a correct position for the edge guide 200 corresponding to the size of the sheets S to be used.

When the edge guide 200 is moved, the edge guide 200 may tend to incline with respect to the first and second rails 110, 120 due to a moment to rotate the handle 420. In this regard, according to the present embodiment, the handle 420 is arranged in the intermediate position between the first rail 110 and the second rail 120 with regard to the front-rear direction. Therefore, while the first and second protrusions 350, 360 in the edge guide 200 contact the first and second rails 110, 120, which are arranged on each side of the handle 420 along the front-rear direction, the edge guide 200 may be restrained from inclining. Accordingly, operability to move the edge guide 200 may be improved.

In particular, according to the present embodiment, the first protrusion 350 and the second protrusion 360 are configured with the rightward and leftward first protrusions 351, 352 and the rightward and leftward second protrusions 361, 362, respectively. In other words, the first protrusion 350 and the second protrusion 360 are distributed intermittently in plural positions along the widthwise direction. Thereby, sliding resistance between the first and second protrusions 350, 360 and the first and second rails 110, 120 may be reduced. Accordingly, the operability to move the edge guide 200 may be improved.

According to the present embodiment, the leftward first protrusion 352 and the leftward second protrusion 362 are formed in the extending part 322. Therefore, longer distances may be reserved between the rightward first protrusion 351 and the leftward first protrusion 352, and between the rightward second protrusion 361 and the leftward second protrusion 362. Therefore, as the edge guide 200 is moved, the edge guide 200 may be restrained from inclining even more effectively by the contact between the first and second protrusions 350, 360 and the first and second rails 110, 120.

Meanwhile, the rightward first protrusion 351 and the rightward second protrusion 361 are arranged to align along the front-rear direction, and the leftward first protrusion 352 and the leftward second protrusion 362 are arranged to align along the front-rear direction. Therefore, a condition, including a widthwise position, for the rightward first protrusion 351 to contact the first rail 110, and a condition, including a widthwise position, for the rightward second protrusion 361 to contact the second rail 120, may be relatively equalized, compared to, for example, an unequal configuration, in which the rightward first protrusion 351 and the rightward second protrusion 361 are arranged in displaced positions from each other with regard to the front-rear direction. This may be similarly applied to the positional relation between the leftward first protrusion 352 and the leftward second protrusion 362. Therefore, as the edge guide 200 is moved, the edge guide 200 may be restricted from inclining even more effectively by the contact between the first and second protrusions 350, 360 and the first and second rails 110, 120 regardless of a direction of inclination for the edge guide 200.

Further, when the edge guide 200 is moved, and if the positioning projection 461 in the positioning part 460 is engaged with the position-indicative notch 160 in the basal bar 130, a rotating moment about the positioning projection 461 may be produced. However, with the positioning part 460 being arranged in the intermediate position between the first rail 110 and the second rail 120 with regard to the front-rear direction, the edge guide 200 may be restricted from inclining by the first protrusion 350 contacting the first rail 110 and the second protrusion 360 contacting the second rail 120.

In particular, according to the present embodiment, the positioning part 460 is in the rectangular area enclosed by the rightward first protrusion 351, the rightward second protrusion 361, the leftward first protrusion 352, and the leftward second protrusion 362. Therefore, as the edge guide 200 is moved, the edge guide 200 may be strained from inclining by the rightward and leftward first protrusions 351, 352, which contact the first rail 110, and the rightward and leftward second protrusions 361, 362, which are arranged diagonally with respect to the leftward and rightward first protrusions 352, 351, respectively to contact the second rail 120.

According to the present embodiment, when the handle 420 is operated, the positioning projection 461 in the positioning part 460 is urged against the rearward face 132. Therefore, the rotating moment about the positioning projection 461 may be produced when the edge guide 200 is moved. However, with the first protrusion 350 and the second protrusion 360 contacting the first rail 110 and the second rail 120 at the front side and the rear side respectively, the edge guide 200 may be restrained from inclining.

According to the present embodiment, as shown in FIG. 6, the gear part 330 is formed to extend from the first extending part 323, of which depth along the front-rear direction is greater than the depth of the gear part 330.

Therefore, rigidity of the gear part 330, to which a load from the pinion gear 600 is applied, may be more securely improved. In other words, the leftward first protrusion 352 is formed in the first extending part 323, which is extended leftward originating from the basal part 321 in order to form the first rack gear 331. Thereby, the longer distance between the rightward first protrusion 351 and the leftward first protrusion 352 may be reserved.

According to the present embodiment, as shown in FIG. 7, the edge guide 200 is formed to have the stopper claws 340 at the frontward and rearward ends thereof. The stopper claws 340 are engaged with the stopper-engageable parts 140, which are formed in the stackable bin 100. Thus, with the upper edges of the stopper claws 340 contacting the lower surfaces of the stopper-engageable parts 140, the edge guide 200 may be prevented from being removed from the stackable bin 100.

Figure 9:
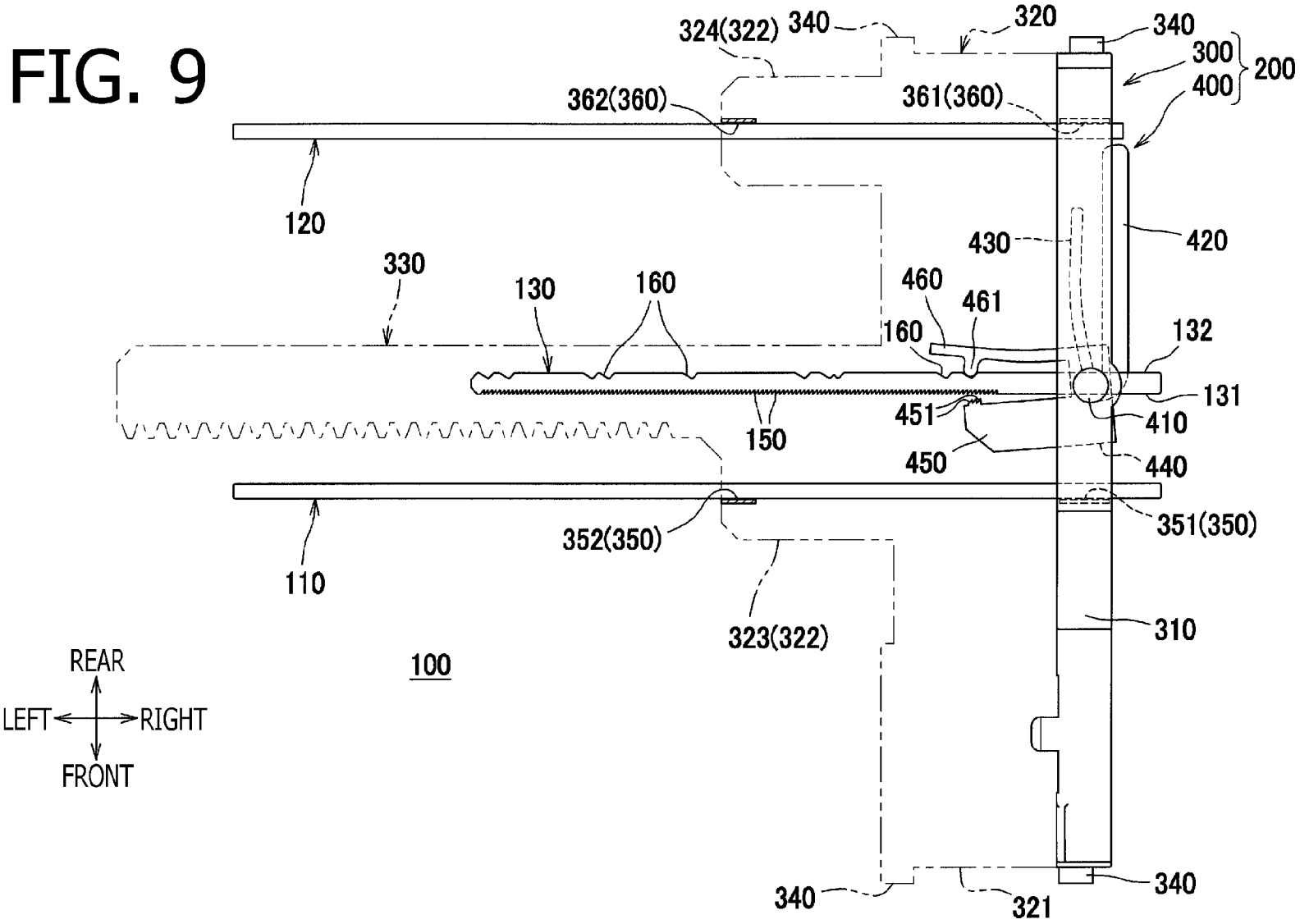
FIG. 9 is a plan view of the edge guide viewed from above when the handle is in an operative position in the feeder tray according to the embodiment of the present disclosure.

As shown in FIG. 9, when the edge guide 200 is in a desired position, the user may release the restrictive plate 310 and the handle 420. Thereby, the handle 420 is moved to rotate clockwise about the shaft 410 by the urging force of the urging part 430 from the operative position to the non-operative position (see FIG. 8). Meanwhile, the locking part 450 is moved to rotate clockwise about the shaft 410 to have the locking projection 451 engaged with a portion of the teeth 150. Thus, the edge guide 200 is restricted from moving. Further, with regard to the positioning part 460, when the edge guide 200 is in the position to restrict the position of the regular-sized sheets S, the positioning projection 461 is placed to engage with one of the position-indicative notches 160. In this regard, the positioning part 460 may not be deformed. On the other hand, when the edge guide 200 is not in any of the positions corresponding to the regular sizes of the sheets S, the positioning projection 461 contacts a part of the rearward face 132 of the basal bar 130, where no position-indicative notch 160 is formed. In this regard, the positioning part 460 may be resiliently deformed.

Although an example of carrying out the invention has been described, those skilled in the art will appreciate that there are numerous variations and permutations of the sheet stackable device and the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, in the above embodiment, as shown in FIG. 6, the edge guide 200 has two extending parts 322, i.e., the first extending part 323 and the second extending part 324, in the base plate 320, which includes the leftward first protrusion 352 and the leftward second protrusion 362, respectively. However, arrangement of the extending parts and the protrusions may not necessarily be limited to that described above. For example, referring to FIG. 6, the edge guide 200 may have solely a single extending part (e.g., the first extending part 323), which may be equipped with the leftward first protrusion 352. Meanwhile, the leftward second protrusion 362 may be arranged at a rearward position on the leftward end of the basal part 321. For another example, the edge guide 200 may have solely a single extending part (e.g., the second extending part 324), which may be equipped with the leftward second protrusion 362 while the leftward first protrusion 352 is arranged at a central position with regard to the front-rear direction on the leftward end of the basal part 321.

For another example, in the above embodiment, the basal bar 130 is elongated along the widthwise direction on the bottom 101 of the stackable bin 100, and the basal bar 130 has the frontward face 131, on which the teeth 150 are formed, on one side thereof along the front-rear direction, and the rearward face 132, on which the position-indicative notches 160 are formed, on the other side thereof along the front-rear direction. Further, the locking part 450 and the positioning part 460 in the edge guide 200 are arranged to clamp the basal bar 130. However, arrangement of the teeth 150, the position-indicative notches 160, the locking part 450, and the positioning part 460 may not necessarily be limited to that described above. For example, a groove elongated along the widthwise direction and dented downward may be formed on the bottom 101 of the stackable bin 100. The lock-engageable teeth may be formed on one of frontward and rearward faces in the groove, and the position-indicative notches may be formed on the other of the frontward and rearward faces in the groove. Meanwhile, the locking part and the positioning part in the edge guide may be arranged inside the groove between the frontward and rearward faces in the groove.

For another example, the first and second rails 110, 120 may not necessarily be formed to protrude from the bottom 101 of the stackable bin 100 while the first and second protrusions 350, 360 may not necessarily be formed to dent to encase the first and second rails 110, 120, respectively. For example, the first and second rails may be formed in a shape of a groove, which is dented and elongated along the bottom 101 of the stackable bin 100 while the first and second protrusions may be formed to protrude downward from the bottom 101 of the stackable bin 100 to be encased in the groove.

For another example, the first and second protrusions 350, 360 may not necessarily be formed intermittently along the widthwise direction but may be formed continuously along the widthwise direction.

For another example, the feeder tray 31 may not necessarily be in the configuration such that the left-side guide 500 includes the pinion gear 600 and the right-side guide 300 includes the gear part 330. In other words, the left-side guide 500, the pinion gear 600, and the gear part 300 in the right-side guide 300 may be omitted from the feeder tray 31 if the sheets S stacked on the stackable bin 100 are sandwiched by a lateral wall of the feeder tray 31 and the restrictive plate of the edge guide, and a widthwise position of the sheets S is restricted by the lateral wall and the edge guide.

For another example, the edge guide 200 may not necessarily be slidably movable with respect to the stackable bin 100 in the widthwise direction so that the edge guide 200 should restrict the widthwise position of the sheets S but may be, for example, the edge guide may be slidably movable with respect to the stackable bin 100 in the front-rear direction so that the edge guide 200 should restrict a position of the sheets S with regard to the front-rear direction.

For another example, the embodiment described above may not necessarily be applied to the laser printer 1, which is configured to print monochrome images, but may be applied to a multicolor laser printer. For another example, the embodiment may not necessarily be applied to an electro-photographically printable laser printer but may be applied to, for example, an inkjet printer or a thermal printer. Further, the embodiment described above may not necessarily be applied to a printer but may be applied to, for example, a copier or a multifunction peripheral device, which is equipped with an image reading device such as a flatbed scanner.

For another example, the sheet stackable device according to the embodiment described above may not necessarily be applied to the feeder tray 31, which is detachably attached to the body 2 of the laser printer 1 but may be applied to, for example, a manual sheet tray for an image forming apparatus and an original document tray for an auto-document feeder in an image reading apparatus. For another example, the sheet stackable device according to the embodiment described above may be applied to a device having a base, on which sheets S should be stacked, other than the image forming apparatus or the image reading apparatus.

For another example, the sheets S being a recording medium may not necessarily be regular printable paper, but may be, for example, OHP sheets or original documents, which are to be stacked in a tray of an auto-document feeder to be read.

What is claimed is:

1. A sheet stackable device, comprising:

a sheet stackable bin; and a first edge guide slidably mounted on the sheet stackable bin to be slidable in a first direction and configured to contact an edge of a sheet when the sheet is stacked on the sheet stackable bin, wherein the sheet stackable bin comprises:

a first rail extending in the first direction and configured to guide the first edge guide;

a second rail extending in the first direction and configured to guide the first edge guide, the second rail being arranged in a position spaced apart from the first rail with regard to a second direction being orthogonal to the first direction; and a plurality of teeth arranged in a position between the first rail and the second rail, the plurality of teeth being arranged along the first direction; and wherein the first edge guide comprises:

a locking part configured to engage with one of the plurality of teeth to restrict the first edge guide from moving in the first direction when the locking part engages with the one of the plurality of teeth; and a handle configured to disengage the locking part toward a direction to be farther from the one of the plurality of teeth;

a first protrusion and a second protrusion both protruding toward the first rail in the second direction and configured to contact the first rail, the first protrusion being arranged closer than the second protrusion to the handle in the first direction, and the second protrusion being arranged farther than the first protrusion from the handle in the first direction; and a third protrusion and a fourth protrusion both protruding toward the second rail in the second direction and configured to contact the second rail, the third protrusion being arranged closer than the fourth protrusion to the handle in the first direction, and the fourth protrusion being arranged farther than the third protrusion from the handle in the first direction wherein the handle is arranged in a position between the first rail and the second rail with regard to the second direction.

2. The sheet stackable device according to claim 1, wherein the first edge guide comprises:

a first restrictive plate configured to contact the edge of the sheet when the sheet is stacked on the sheet stackable bin; and a base plate formed to extend from a lower end of the first restrictive plate to extend along the first direction, wherein the base plate comprises:

a basal part connected to the lower end of the first restrictive plate; and a first extending part extending from the basal part along the first direction, and wherein the first extending part comprises the second sideward first protrusion.

3. The sheet stackable device according to claim 2, wherein the base plate further comprises a second extending part extending from the basal part along the first direction, and wherein the second extending part comprises the fourth protrusion.

4. The sheet stackable device according to claim 2, wherein the first edge guide comprises a first gear part extending from the base plate along the first direction, the first gear part being formed to have a first rack gear on a face thereof that extends orthogonally to the second direction, wherein the sheet stackable device further comprises a second edge guide slidably mounted on the sheet stackable bin to be slidable in the first direction, the second edge guide comprising:

a second restrictive plate configured to contact another edge of the sheet sandwiched by the first edge guide and the second edge guide when the sheet is stacked on the sheet stackable bin; and a second gear part extending from the base plate along the first direction, the second gear part being formed to have a second rack gear arranged at least partly to face with the first rack gear with regard to the second direction, and wherein the sheet stackable device further comprises a pinion gear arranged to be rotatable with respect to the stackable bin in a position between the first rack gear and the second rack gear, the pinion gear being engaged with the first rack gear and the second rack gear.

5. The sheet stackable device according to claim 1, wherein the first protrusion and the third protrusion are arranged to align along the second direction, and wherein the second protrusion and the fourth protrusion are arranged to align along the second direction.

6. The sheet stackable device according to claim 1, wherein the sheet stackable bin comprises a plurality of position-indicative parts arranged along the first direction in positions corresponding to various sizes of the sheet, wherein the first edge guide comprises a positioning part configured to be resiliently deformable to be engageable with and disengageable from one of the plurality of position-indicative parts, and wherein the positioning part is arranged in a position between the first rail and the second rail with regard to the second direction.

7. The sheet stackable device according to claim 6, wherein the positioning part is arranged in an area between the first protrusion and the second protrusion, and between the first protrusion and the third protrusion.

8. The sheet stackable device according to claim 1, wherein the first edge guide comprises a first restrictive plate configured to contact the edge of the sheet when the sheet is stacked on the sheet stackable bin, and wherein the handle is configured to be rotatable about a shaft, the shaft being arranged in the first restrictive plate and extending in a third direction, to manipulate the locking part to be disengaged from the one of the plurality of teeth.

9. The sheet stackable device according to claim 8, wherein the sheet stackable bin comprises:

a first face, on which the plurality of teeth are arranged to be oriented to the second direction; and a second face, on which a plurality of position-indicative parts are arranged to be oriented to the second direction in positions corresponding to various sizes of the sheet, wherein the first edge guide comprises a positioning part configured to be resiliently deformable to be engageable with and disengageable from one of the plurality of position-indicative parts and a first restrictive plate configured to contact the edge of the sheet when the sheet is stacked on the sheet stackable bin, wherein the locking part and the positioning part are configured to be integrally rotatable about the shaft, wherein, when the handle is in a non-operative position, in which the handle is arranged in a position spaced apart from the first restrictive plate, the locking part and the positioning part are placed in a restrictive position, in which the locking part engages with the one of the plurality of teeth, and wherein, when the handle is in an operative position, in which the handle is arranged closer to the first restrictive plate in the first direction than the non-operative position, the locking part and the positioning part are placed in a released position, in which the locking part is disengaged from the one of the plurality of teeth while the locking part is resiliently deformed and urged against the second face.

10. The sheet stackable device according to claim 1, wherein the first edge guide comprises a stopper part, which is arranged on each end of the first edge guide with regard to the second direction, and wherein the sheet stackable bin comprises a stopper-engageable part arranged on each outer side of the first rail and the second rail with regard to the second direction, the stopper-engageable part extending along the first direction and being configured to be in contact with an upper surface of the stopper part to be engageable with the stopper part.

11. An image forming apparatus, comprising:

a sheet stackable device comprising a sheet stackable bin and a first edge guide; and an image forming unit configured to form an image on the sheet, wherein the first edge guide is slidably mounted on the sheet stackable bin to be slidable in a first direction and configured to contact an edge of a sheet when the sheet is stacked on the sheet stackable bin, wherein the sheet stackable bin comprises:

a first rail extending in the first direction and configured to guide the first edge guide;

a second rail extending in the first direction and configured to guide the first edge guide, the second rail being arranged in a position spaced apart from the first rail with regard to a second direction being orthogonal to the first direction; and a plurality of teeth arranged in a position between the first rail and the second rail, the plurality of teeth being arranged along the first direction; and wherein the first edge guide comprises:

a locking part configured to engage with one of the plurality of teeth to restrict the first edge guide from moving in the first direction when the locking part engages with the one of the plurality of teeth; and a handle configured to disengage the locking part toward a direction to be farther from the one of the plurality of teeth;

a first protrusion and a second protrusion both protruding toward the first rail in the second direction and configured to contact the first rail, the first protrusion being arranged closer than the second protrusion to the handle in the first direction, and the second protrusion being arranged farther than the first protrusion from the handle in the first direction, and a third protrusion and a fourth protrusion both protruding toward the second rail in the second direction and configured to contact the second rail, the third protrusion being arranged closer than the fourth protrusion to the handle in the first direction, and the fourth protrusion being arranged farther than the third protrusion from the handle in the first direction, wherein the handle is arranged in a position between the first rail and the second rail with regard to the second direction.

* * * * *